US007202818B2

(12) United States Patent
Anguera Pros et al.

(10) Patent No.: US 7,202,818 B2
(45) Date of Patent: Apr. 10, 2007

(54) MULTIFREQUENCY MICROSTRIP PATCH ANTENNA WITH PARASITIC COUPLED ELEMENTS

(75) Inventors: Jaume Anguera Pros, Castellion (ES); Carles Puente Ballarda, Barcelona (ES)

(73) Assignee: Fractus, S.A., Santcugat Del Valles (ES)

( * ) Notice: Subject to any disclaimer, the term of this patent is extended or adjusted under 35 U.S.C. 154(b) by 463 days.

(21) Appl. No.: 10/823,206

(22) Filed: Apr. 13, 2004

(65) Prior Publication Data

US 2005/0190106 A1 Sep. 1, 2005

Related U.S. Application Data

(63) Continuation of application No. PCT/EP01/11913, filed on Oct. 16, 2001.

(51) Int. Cl.
*H01Q 1/38* (2006.01)

(52) U.S. Cl. ..... 343/700 MS; 343/846

(58) Field of Classification Search ..... 343/700 MS, 343/846, 833, 834

See application file for complete search history.

(56) References Cited

U.S. PATENT DOCUMENTS

| | | | | |
|---|---|---|---|---|
| 3,521,284 | A | 7/1970 | Shelton, Jr. et al. | |
| 3,599,214 | A | 8/1971 | Altmayer | |
| 3,622,890 | A | 11/1971 | Fujimoto et al. | |
| 3,683,376 | A | 8/1972 | Pronovost | |
| 3,818,490 | A | 6/1974 | Leahy | |
| 3,967,276 | A | 6/1976 | Goubau | |
| 3,969,730 | A | 7/1976 | Fuchser | |
| 4,024,542 | A | 5/1977 | Ikawa et al. | |
| 4,131,893 | A | 12/1978 | Munson et al. | |
| 4,141,016 | A | 2/1979 | Nelson | |
| 4,218,682 | A * | 8/1980 | Frosch et al. | 343/700 MS |
| 4,401,988 | A * | 8/1983 | Kaloi | 343/700 MS |
| 4,471,358 | A | 9/1984 | Glasser | |
| 4,471,493 | A | 9/1984 | Schober | |
| 4,504,834 | A | 3/1985 | Garay et al. | |
| 4,543,581 | A | 9/1985 | Nemet | |
| 4,571,595 | A | 2/1986 | Phillips et al. | |
| 4,584,709 | A | 4/1986 | Kneisel et al. | |
| 4,590,614 | A | 5/1986 | Erat | |
| 4,623,894 | A | 11/1986 | Lee et al. | |
| 4,673,948 | A | 6/1987 | Kuo | |
| 4,730,195 | A | 3/1988 | Phillips et al. | |
| 4,839,660 | A | 6/1989 | Hadzoglou | |
| 4,843,468 | A | 6/1989 | Drewery | |

(Continued)

FOREIGN PATENT DOCUMENTS

| | | |
|---|---|---|
| DE | 3337941 | 5/1985 |

(Continued)

OTHER PUBLICATIONS

Ali, M. et al., "A Triple-Band Internal Antenna for Mobile Hand-held Terminals," IEEE, pp. 32-35 (1992).

(Continued)

*Primary Examiner*—Hoang V. Nguyen
(74) *Attorney, Agent, or Firm*—Jenkens & Gilchrist, P.C.

(57) ABSTRACT

A multifrequency microstrip patch antenna comprising an active patch and a plurality of parasitic elements placed underneath said active patch, featuring a similar behavior (impedance, directivity, gain, polarization and pattern) at multiple radiofrequency bands.

21 Claims, 4 Drawing Sheets

U.S. PATENT DOCUMENTS

| | | | | |
|---|---|---|---|---|
| 4,847,629 | A | 7/1989 | Shimazaki | |
| 4,849,766 | A | 7/1989 | Inaba et al. | |
| 4,857,939 | A | 8/1989 | Shimazaki | |
| 4,890,114 | A | 12/1989 | Egashira | |
| 4,894,663 | A | 1/1990 | Urbish et al. | |
| 4,907,011 | A | 3/1990 | Kuo | |
| 4,912,481 | A | 3/1990 | Mace et al. | |
| 4,975,711 | A | 12/1990 | Lee | |
| 5,030,963 | A | 7/1991 | Tadama | |
| 5,138,328 | A | 8/1992 | Zibrik et al. | |
| 5,168,472 | A | 12/1992 | Lockwood | |
| 5,172,084 | A | 12/1992 | Fiedziuszko et al. | |
| 5,200,756 | A | 4/1993 | Feller | |
| 5,210,542 | A | 5/1993 | Pett et al. | |
| 5,214,434 | A | 5/1993 | Hsu | |
| 5,218,370 | A | 6/1993 | Blaese | |
| 5,227,804 | A | 7/1993 | Oda | |
| 5,227,808 | A | 7/1993 | Davis | |
| 5,245,350 | A | 9/1993 | Sroka | |
| 5,248,988 | A | 9/1993 | Makino | |
| 5,255,002 | A | 10/1993 | Day | |
| 5,257,032 | A | 10/1993 | Diamond et al. | |
| 5,307,075 | A * | 4/1994 | Huynh | 343/700 MS |
| 5,347,291 | A | 9/1994 | Moore | |
| 5,355,144 | A | 10/1994 | Walton et al. | |
| 5,355,318 | A | 10/1994 | Dionnet et al. | |
| 5,373,300 | A | 12/1994 | Jenness et al. | |
| 5,402,134 | A | 3/1995 | Miller et al. | |
| 5,420,599 | A | 5/1995 | Erkocevic | |
| 5,422,651 | A | 6/1995 | Chang | |
| 5,451,965 | A | 9/1995 | Matsumoto | |
| 5,451,968 | A | 9/1995 | Emery | |
| 5,453,751 | A | 9/1995 | Tsukamoto et al. | |
| 5,457,469 | A | 10/1995 | Diamond et al. | |
| 5,471,224 | A | 11/1995 | Barkeshli | |
| 5,493,702 | A | 2/1996 | Crowley et al. | |
| 5,495,261 | A | 2/1996 | Baker et al. | |
| 5,497,164 | A * | 3/1996 | Croq | 343/700 MS |
| 5,534,877 | A | 7/1996 | Sorbello et al. | |
| 5,537,367 | A | 7/1996 | Lockwood et al. | |
| 5,627,550 | A | 5/1997 | Sanad | |
| 5,680,144 | A | 10/1997 | Sanad | |
| 5,684,672 | A | 11/1997 | Karidis et al. | |
| 5,712,640 | A | 1/1998 | Andou et al. | |
| 5,767,811 | A | 6/1998 | Mandai et al. | |
| 5,798,688 | A | 8/1998 | Schofield | |
| 5,821,907 | A | 10/1998 | Zhu et al. | |
| 5,841,403 | A | 11/1998 | West | |
| 5,870,066 | A | 2/1999 | Asakura et al. | |
| 5,872,546 | A | 2/1999 | Ihara et al. | |
| 5,898,404 | A | 4/1999 | Jou | |
| 5,903,240 | A | 5/1999 | Kawahata et al. | |
| 5,926,141 | A | 7/1999 | Lindenmeier et al. | |
| 5,943,020 | A | 8/1999 | Liebendoerfer et al. | |
| 5,966,098 | A | 10/1999 | Qi et al. | |
| 5,973,651 | A | 10/1999 | Suesada et al. | |
| 5,986,610 | A | 11/1999 | Miron | |
| 5,990,838 | A | 11/1999 | Burns et al. | |
| 6,002,367 | A | 12/1999 | Engblom et al. | |
| 6,028,568 | A | 2/2000 | Asakura et al. | |
| 6,031,499 | A | 2/2000 | Dichter | |
| 6,031,505 | A | 2/2000 | Qi et al. | |
| 6,078,294 | A | 6/2000 | Mitarai | |
| 6,091,365 | A | 7/2000 | Derneryd et al. | |
| 6,097,345 | A | 8/2000 | Walton | |
| 6,104,349 | A | 8/2000 | Cohen | |
| 6,118,406 | A * | 9/2000 | Josypenko | 343/700 MS |
| 6,127,977 | A | 10/2000 | Cohen | |
| 6,131,042 | A | 10/2000 | Lee et al. | |
| 6,133,882 | A * | 10/2000 | LaFleur et al. | 343/700 MS |
| 6,140,969 | A | 10/2000 | Lindenmeier et al. | |
| 6,140,975 | A | 10/2000 | Cohen | |
| 6,160,513 | A | 12/2000 | Davidson et al. | |
| 6,172,618 | B1 | 1/2001 | Hakozaki et al. | |
| 6,211,824 | B1 | 4/2001 | Holden et al. | |
| 6,218,992 | B1 | 4/2001 | Sadler et al. | |
| 6,236,372 | B1 | 5/2001 | Lindenmeier et al. | |
| 6,266,023 | B1 | 7/2001 | Nagy et al. | |
| 6,281,846 | B1 | 8/2001 | Puente Baliarda et al. | |
| 6,307,511 | B1 | 10/2001 | Ying et al. | |
| 6,329,951 | B1 | 12/2001 | Wen et al. | |
| 6,329,954 | B1 | 12/2001 | Fuchs et al. | |
| 6,348,892 | B1 * | 2/2002 | Annamaa et al. | 343/700 MS |
| 6,367,939 | B1 | 4/2002 | Carter et al. | |
| 6,407,710 | B2 | 6/2002 | Keilen et al. | |
| 6,414,637 | B2 | 7/2002 | Keilen | |
| 6,417,810 | B1 | 7/2002 | Huels et al. | |
| 6,431,712 | B1 | 8/2002 | Turnbull | |
| 6,445,352 | B1 | 9/2002 | Cohen | |
| 6,452,549 | B1 | 9/2002 | Lo | |
| 6,452,553 | B1 | 9/2002 | Cohen | |
| 6,476,766 | B1 | 11/2002 | Cohen | |
| 6,525,691 | B2 | 2/2003 | Varadan et al. | |
| 6,552,690 | B2 | 4/2003 | Veerasamy | |
| 6,639,558 | B2 | 10/2003 | Kellerman et al. | |
| 2002/0000940 | A1 | 1/2002 | Moren et al. | |
| 2002/0000942 | A1 | 1/2002 | Duroux | |
| 2002/0036594 | A1 | 3/2002 | Gyenes | |
| 2002/0105468 | A1 | 8/2002 | Tessier et al. | |
| 2002/0109633 | A1 | 8/2002 | Ow et al. | |
| 2002/0126054 | A1 | 9/2002 | Fuerst et al. | |
| 2002/0126055 | A1 | 9/2002 | Lindenmeier et al. | |
| 2002/0175866 | A1 | 11/2002 | Gram | |
| 2003/0142036 | A1 | 7/2003 | Wilhelm et al. | |

FOREIGN PATENT DOCUMENTS

| | | |
|---|---|---|
| EP | 0096847 | 12/1983 |
| EP | 0297813 | 6/1988 |
| EP | 0358090 | 8/1989 |
| EP | 0543645 | 5/1993 |
| EP | 0571124 | 11/1993 |
| EP | 0688040 | 12/1995 |
| EP | 0765001 | 3/1997 |
| EP | 0814536 | 12/1997 |
| EP | 0871238 | 10/1998 |
| EP | 0892459 | 1/1999 |
| EP | 0929121 | 7/1999 |
| EP | 0932219 | 7/1999 |
| EP | 0969375 | 1/2000 |
| EP | 0986130 | 3/2000 |
| EP | 0942488 | 4/2000 |
| EP | 0997974 | 5/2000 |
| EP | 1018777 | 7/2000 |
| EP | 1018779 | 7/2000 |
| EP | 1071161 | 1/2001 |
| EP | 1079462 | 2/2001 |
| EP | 1083624 | 3/2001 |
| EP | 1094545 | 4/2001 |
| EP | 1096602 | 5/2001 |
| EP | 1148581 | 10/2001 |
| EP | 1168493 | 1/2002 |
| EP | 1198027 | 4/2002 |
| EP | 1237224 | 9/2002 |
| EP | 1267438 | 12/2002 |
| ES | 2112163 | 3/1998 |
| ES | 2142280 | 5/1998 |
| FR | 2543744 | 10/1984 |
| FR | 2704359 | 10/1994 |
| GB | 2215136 | 9/1989 |
| GB | 2330951 | 5/1999 |
| GB | 2355116 | 4/2001 |
| JP | 55147806 | 11/1980 |
| JP | 5007109 | 1/1993 |

| | | |
|---|---|---|
| JP | 5129816 | 5/1993 |
| JP | 5267916 | 10/1993 |
| JP | 5347507 | 12/1993 |
| JP | 6204908 | 7/1994 |
| JP | 10209744 | 8/1998 |
| WO | 9511530 | 4/1995 |
| WO | 9627219 | 9/1996 |
| WO | 9629755 | 9/1996 |
| WO | 9638881 | 12/1996 |
| WO | 9706578 | 2/1997 |
| WO | 9711507 | 3/1997 |
| WO | 9732355 | 9/1997 |
| WO | 9733338 | 9/1997 |
| WO | 9735360 | 9/1997 |
| WO | 9747054 | 12/1997 |
| WO | 9812771 | 3/1998 |
| WO | 9836469 | 8/1998 |
| WO | 9903166 | 1/1999 |
| WO | 9903167 | 1/1999 |
| WO | 9925042 | 5/1999 |
| WO | 9927608 | 6/1999 |
| WO | 9956345 | 11/1999 |
| WO | 0001028 | 1/2000 |
| WO | 0003453 | 1/2000 |
| WO | 0022695 | 4/2000 |
| WO | 0036700 | 6/2000 |
| WO | 0049680 | 8/2000 |
| WO | 0052784 | 9/2000 |
| WO | 0052787 | 9/2000 |
| WO | 0103238 | 1/2001 |
| WO | 0108257 | 2/2001 |
| WO | 0113464 | 2/2001 |
| WO | 0117064 | 3/2001 |
| WO | 0122528 | 3/2001 |
| WO | 0124314 | 4/2001 |
| WO | 0126182 | 4/2001 |
| WO | 0128035 | 4/2001 |
| WO | 0131739 | 5/2001 |
| WO | 0133665 | 5/2001 |
| WO | 0135491 | 5/2001 |
| WO | 0137369 | 5/2001 |
| WO | 0137370 | 5/2001 |
| WO | 0141252 | 6/2001 |
| WO | 0148861 | 7/2001 |
| WO | 0154225 | 7/2001 |
| WO | 0173890 | 10/2001 |
| WO | 0178192 | 10/2001 |
| WO | 0182410 | 11/2001 |
| WO | 0235646 | 5/2002 |
| WO | WO-02/063714 | 8/2002 |
| WO | 02091518 | 11/2002 |
| WO | 02096166 | 11/2002 |
| WO | WO-03/003503 | 1/2003 |

OTHER PUBLICATIONS

Romeu, Jordi et al., "A Three Dimensional Hilbert Antenna," IEEE, pp. 550-553 (2002).
Parker et al., "Microwaves, Antennas & Propagation," IEEE Proceedings H, pp. 19-22 (Feb. 1991).
Hansen, R.C., "Fundamental Limitations in Antennas," Proceedings of the IEEE, vol. 69, No. 2, pp. 170-182 (Feb. 1981).
Jaggard, Dwight L., "Fractal Electrodynamics and Modeling," Directions in Electromagnetic Wave Modeling, pp. 435-446 (1991).
Hohlfeld, Robert G. et al., "Self-Similarity and the Geometric Requirements for Frequency Independence in Antennae," Fractals, vol. 7, No. 1, pp. 79-84 (1999).
Samavati, Hirad, et al., "Fractal Capacitors," IEEE Journal of Solid-State Circuits, vol. 33, No. 12, pp. 2035-2041 (Dec. 1998).
Pribetich, P., et al., "Quasifractal Planar Microstrip Resonators for Microwave Circuits," Microwave and Optical Technology Letters, vol. 21, No. 6, pp. 433-436 (Jun. 20, 1999).
Zhang, Dawei, et al., "Narrowband Lumped-Element Microstrip Filters Using Capacitively-Loaded Inductors," IEEE MTT-S Microwave Symposium Digest, pp. 379-382 (May 16, 1995).
Gough, C.E., et al., "High Tc coplanar resonators for microwave applications and scientific studies," Physica C, NL,North-Holland Publishing, Amsterdam, vol. 282-287, No. 2001, pp. 395-398 (Aug. 1, 1997).
Radio Engineering Reference—Book by H. Meinke and F.V. Gundlah, vol. I, Radio components. Circuits with lumped parameters. Transmission lines. Wave-guides. Resonators. Arrays. Radio waves propagation, States Energy Publishing House, Moscow, with English translation (1961) [4 pp.].
V.A. Volgov, "Parts and Units of Radio Electronic Equipment (Design & Computation)," Energiya, Moscow, with English translation (1967) [4 pp.].
Puente, C., et al., "Multiband properties of a fractal tree antenna generated by electrochemical deposition," Electronics Letters, IEE Stevenage, GB, vol. 32, No. 25, pp. 2298-2299 (Dec. 5, 1996).
Puente, C., et al., "Small but long Koch fractal monopole," Electronics Letters, IEE Stevenage, GB, vol. 34, No. 1, pp. 9-10 (Jan. 8, 1998).
Puente Baliarda, Carles, et al., "The Koch Monopole: A Small Fractal Antenna," IEEE Transactions on Antennas and Propagation, New York, US, vol. 48, No. 11, pp. 1773-1781 (Nov. 1, 2000).
Cohen, Nathan, "Fractal Antenna Applications in Wireless Telecommunications," Electronics Industries Forum of New England, 1997. Professional Program Proceedings Boston, MA US, May 6-8, 1997, New York, NY US, IEEE, US pp. 43-49 (May 6, 1997).
Anguera, J. et al. "Miniature Wideband Stacked Microstrip Patch Antenna Based on the Sierpinski Fractal Geometry," IEEE Antennas and Propagation Society International Symposium, 2000 Digest. Aps., vol. 3 of 4, pp. 1700-1703 (Jul. 16, 2000).
Hara Prasad, R.V., et al., "Microstrip Fractal Patch Antenna for Multi-Band Communication," Electronics Letters, IEE Stevenage, GB, vol. 36, No. 14, pp. 1179-1180 (Jul. 6, 2000).
Borja, C. et al., "High Directivity Fractal Boundary Microstrip Patch Antenna," Electronics Letters. IEE Stevenage, GB, vol. 36, No. 9, pp. 778-779 (Apr. 27, 2000).
Sanad, Mohamed, "A Compact Dual-Broadband Microstrip Antenna Having Both Stacked and Planar Parasitic Elements," IEEE Antennas and Propagation Society International Symposium 1996 Digest, Jul. 21-26, 1996, pp. 6-9.
Anguera, J. et al., "A Procedure to Design Stacked Microstrip Patch Antennas Based on a Simple Network Model", Microwave and Optical Technology Letters, vol. 30, No. 3, Aug. 5, 2001, pp. 149-151.
Dyson, John D., "The Unidirectional Equiangular Spiral Antenna", IRE Transactions on Antennas and Propagation, Oct. 1959, pp. 329-334.
Anguera, Jaume et al., "A Procedure to Design Wide-Band Electromagnetically-Coupled Stacked Microstrip Antennas Based on a Simple Network Model", IEEE, 1999, 4 pages.
Anguera, Jaume et al., "Multifrequency Microstrip Patch Antenna Using Multiple Stacked Elements", IEEE Microwave and Wireless Components Letters, vol. 13, No. 3, Mar. 2003, pp. 123-124.
Moleiro, Alexandre et al., "Dual Band Microstrip Patch Antenna Element with Parasitic for GSM", IEEE, 2000, 4 pages.
Anguera, Jaume et al., "Antennas Microstrip Apiladas con Geometria de Anillo", Fractus SA, 2 pages, no date avail.
Herscovici, Naftali, "New Considerations in the Design of Microstrip Antennas", IEEE Transactions on Antennas and Propagation, vol. 46, No. 6, Jun. 1998, pp. 807-812.
Carver, Keith R. et al., "Microstrip Antenna Technology", IEEE Transactions on Antennas and Propagation, vol. AP-29, No. 1, Jan. 1981, pp. 2-24.
Croq, Frederic, "Multifrequency Operation of Microstrip Antennas Using Aperture Coupled Parallel Resonators", IEEE Transactions on Antennas and Propagation, vol. 40, No. 11, Nov. 1992, pp. 1367-1374.
Rumsey, V. H., "Frequency Independent Antennas", University of Illinois, p. 114-118, no date avail.
Reddy, K. T. V. et al., "Stacked Microstrip Antennas for Broadband Circular Polarization", IEEE, pp. 420-423, 2001.
Yang, X. H. et al., "Multifrequency Operation Technique for Aperture Coupled Microstrip Antennas", IEEE, pp. 1198-1201, 1994.

* cited by examiner

MULTIFREQUENCY MICROSTRIP PATCH ANTENNA WITH PARASITIC COUPLED ELEMENTS

This application is a continuation of PCT/EP01/11913 dated Oct. 16, 2001.

OBJECT AND BACKGROUND OF THE INVENTION

The present invention refers to a new class of microstrip antennas with a multifrequency behaviour based on stacking several parasitic patches underneath an active upper patch.

An antenna is said to be multifrequency when the radio-electrical performance (impedance, polarization, pattern, etc.) is invariant for different operating frequencies. The concept of multifrequency antennas derives of frequency independent antennas. Frequency independent antennas were first proposed by V. H. Rumsey (V. H. Rumsey, "*Frequency Independent Antennas*", 1957 *IRE National Convention Record*, pt. 1, pp. 114–118) and can be defined as a family of antennas whose performance (impedance, polarization, pattern . . . ) remains the same for any operating frequency. Rumsey work led to the development of the log-periodic antenna and the log-periodic array. Different groups of independent antennas can be found in the literature as the self-scalable antennas based directly in Rumsey's Principle as spiral antennas (J. D. Dyson, "The Unidirectional Equiangular Spiral Antenna", IRE Trans. Antennas Propagation, vol. AP-7, pp. 181–187, October 1959) and self-complementary antennas based on Babinet's Principle. This principle was extended later on by Y. Mushiake in 1948.

An analogous set of antennas are multifrequency antennas where the antenna behaviour is the same but at a discrete set of frequencies. Multilevel antennas such as those described in Patent Publication No. WO01/22528 "Multilevel Antennas" are an example of a kind of antennas which due to their geometry they behave in a similar way at several frequency bands, that is, they feature a multifrequency (multiband) behavior.

In this case, the concept of multifrequency antennas is applied in an innovative way to microstrip antennas, obtaining this way a new generation of multifrequency microstrip patch antennas. The multifrequency behaviour is obtained by means of parasitic microstrip patches placed at different heights under the active patch. Some of the advantages of microstrip patch antennas with respect to other antenna configurations are: lightweight, low volume, low profile, simplicity and, low fabrication cost.

Some attempts to design microstrip patch antennas appear in the literature by means of adding several parasitic patches in a two dimensional, co-planar configuration (F. Croq, D. M. Pozar, "Multifrequency Operation of Microstrip Antennas Using Aperture Coupled Parallel Resonators", IEEE Transactions on Antennas and Propagation, vol. 40, no°11, pp. 1367–1374, November 1992). Also, several examples of broadband or multiband antennas consisting on a set of parasitic layers on top of an active patch are described in the literature (see for instance J. Anguera, C. Puente, C. Borja, "A Procedure to Design Stacked Microstrip Patch Antennas Based on a Simple Network Model", Microwave and Opt. Tech. Letters, Vol. 30, no. 3, Wiley, June, 2001); however it should be stressed that in that case the parasitic layers are placed on top of the fed patch (the active patch), while in the present invention the patches are placed underneath said active patch, yielding to a more compact and mechanically stable design with yet still featuring a multiband or broadband behavior.

It is interesting noticing that any of the patch geometries described in the prior art can be used in an innovative way for either the active or parasitic patches disclosed in the present invention. An example of prior art geometries are square, circular, rectangular, triangular, hexagonal, octagonal, fractal, space-filling ("Space-Filling Miniature Antennas", Patent Publication No. WO01/54225) or again, said Multilevel geometries (WO01/22528).

On the other hand, an Space-Filling Curve (hereafter SFC) is a curve that is large in terms of physical length but small in terms of the area in which the curve can be included. More precisely, the following definition is taken in this document for a space-filling curve: a curve composed by at least ten segments which are connected in such a way that each segment forms an angle with their neighbours, that is, no pair of adjacent segments define a larger straight segment, and wherein the curve can be optionally periodic along a fixed straight direction of space if, and only if, the period is defined by a non-periodic curve composed by at least ten connected segments and no pair of said adjacent and connected segments defines a straight longer segment. Also, whatever the design of such SFC is, it can never intersect with itself at any point except the initial and final point (that is, the whole curve can be arranged as a closed curve or loop, but none of the parts of the curve can become a closed loop). A space-filling curve can be fitted over a flat or curved surface, and due to the angles between segments, the physical length of the curve is always larger than that of any straight line that can be fitted in the same area (surface) as said space-filling curve. Additionally, to properly shape the ground-plane according to the present invention, the segments of the SFC curves included in said ground-plane must be shorter than a tenth of the free-space operating wavelength.

SUMMARY OF THE INVENTION

One of the main features of the present invention is the performance of the design as a multifrequency microstrip patch antenna. The proposed antenna is based on an active microstrip patch antenna and at least two parasitic patches are placed underneath the active patch, in the space between said upper patch and the ground-plane or ground-counterpoise. The spacing among patches can be filled with air or for instance with a dielectric material to provide compact mechanical design. One or more feeding sources can be used to excite the said active patch to obtain dual polarized or circular polarized antenna. The feeding mechanism of said active patch can be for example a coaxial line attached to the active patch. Any of the well known matching networks and feeding means described in the prior art (for instance gap or slot coupled structures, 'L-shaped' probes or coaxial lines) can be also used. Due to its structure, the antenna is able to operate simultaneously at several frequency bands of operation having each band excellent values of return losses (from −6 dB to −60 dB depending on the application) and similar radiation patterns throughout all the bands.

The advantage of this novel antenna configuration with respecto to the prior art is two-fold. On one hand, the invention provides a compact and robust mechanical design, with a low-profile compared to other prior art stacked configurations, and with a single feed for all frequencies. On the other hand, the inclusion of many resonant elements, i.e. the parasitic patches, that can be tunned individually provides a high degree of freedom in tayloring the antenna frequency response to a multiband or broadband behavior. This way, the antenna device finds place in many applications where the integration of multiple wireless services (such as for instance AMPS, GSM900, GSM1800, PCS1899, CDMA, UMTS, Bluetooth, TACS, ETACS, DECT, Radio FM/AM, DAB, GPS) into a single antenna device is required.

DETAILED DESCRIPTION OF SOME PREFERRED EMBODIMENTS OF THE INVENTION

Figure 1:
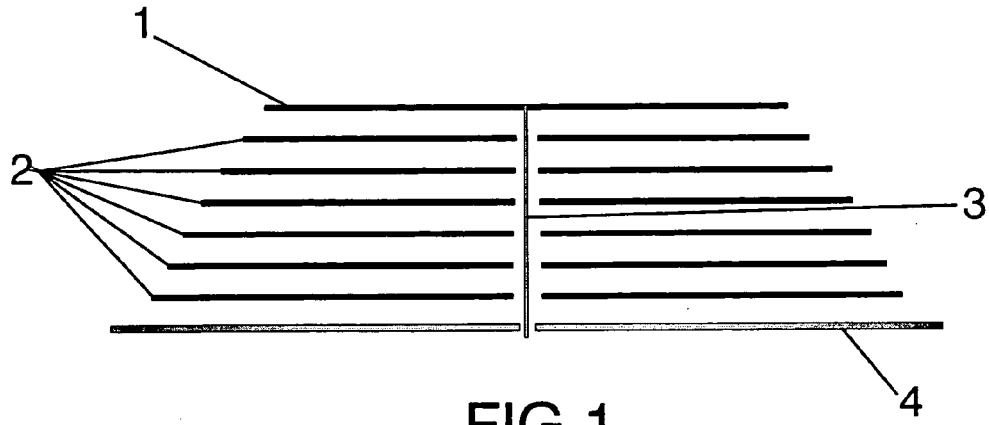
FIG. 1.—Shows an active patch fed by a coaxial probe and six parasitic patches placed underneath the said active patch.

FIG. 1 describes a preferred embodiment of the multifrequency microstrip patch antenna formed by an active patch (1) fed by a coaxial probe (3) and several parasitic patches (2) placed underneath the said active patch (1). Either the active patch (1) and parasitic patches (2) can be for instance printed over a dielectric substrate or, alternatively they can be conformed through a laser process. In general, any of the well-known printed circuit fabrication or other prior-art techniques for microstrip patch antennas can be applied to physically implement the patches and do not constitute an essential part of the invention. In some preferred embodiments, said dielectric substrate is a glass-fibre board (FR4), a Teflon based substrate (such as Cuclad®) or other standard radiofrequency and microwave substrates (such as for instance Rogers 4003® or Kapton®). The dielectric substrate can even be a portion of a window glass if the antenna is to be mounted in a motor vehicle such as a car, a train or an airplane, to transmit or receive electromagnetic ways associated to, for instance, some telecommunications systems such as radio, TV, cellular telephone (GSM 900, GSM 1800, UMTS) or satellite applications (GPS, Sirius and so on). Due to the multifrequency nature of the antenna, all these systems, some of them, or a combination of some of them with other telecommunications systems can operate simultaneously through the antenna described in the present invention. Of course, a matching, filtering or amplifying network (to name some examples) can be connected or integrated at the input terminals of the active patch (1).

Figure 2:
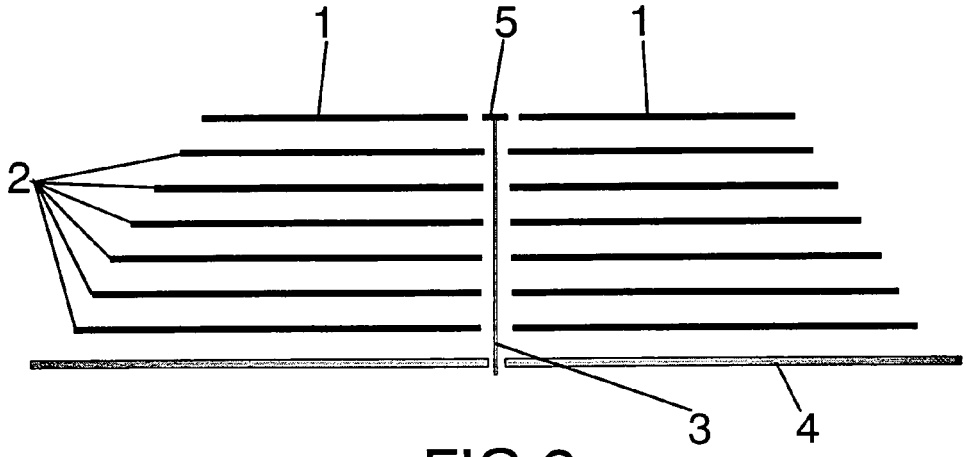
FIG. 2.—As FIG. 1 but in this case the active patch is fed by a coaxial probe and a capacitor etched on the same surface where the active patch is etched.
Figure 3:
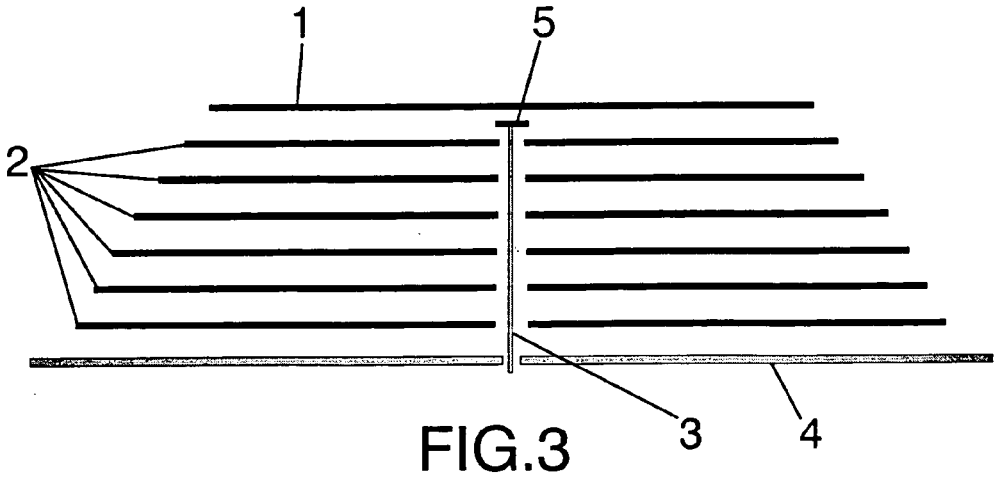
FIG. 3.—As FIG. 1 but in this case the active patch is fed by a coaxial probe and a capacitor under the active patch.
Figure 4:
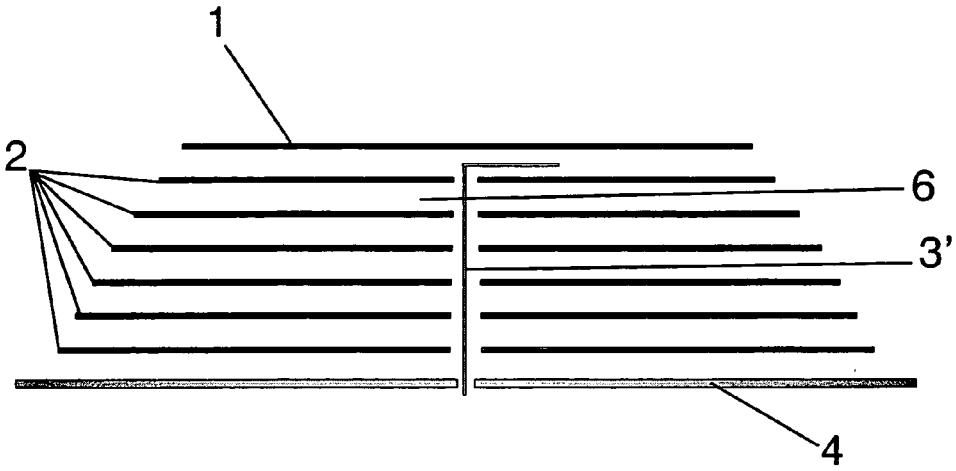
FIG. 4 As FIG. 1 but in this case the active patch is fed by a L-shaped coaxial probe.
Figure 7:
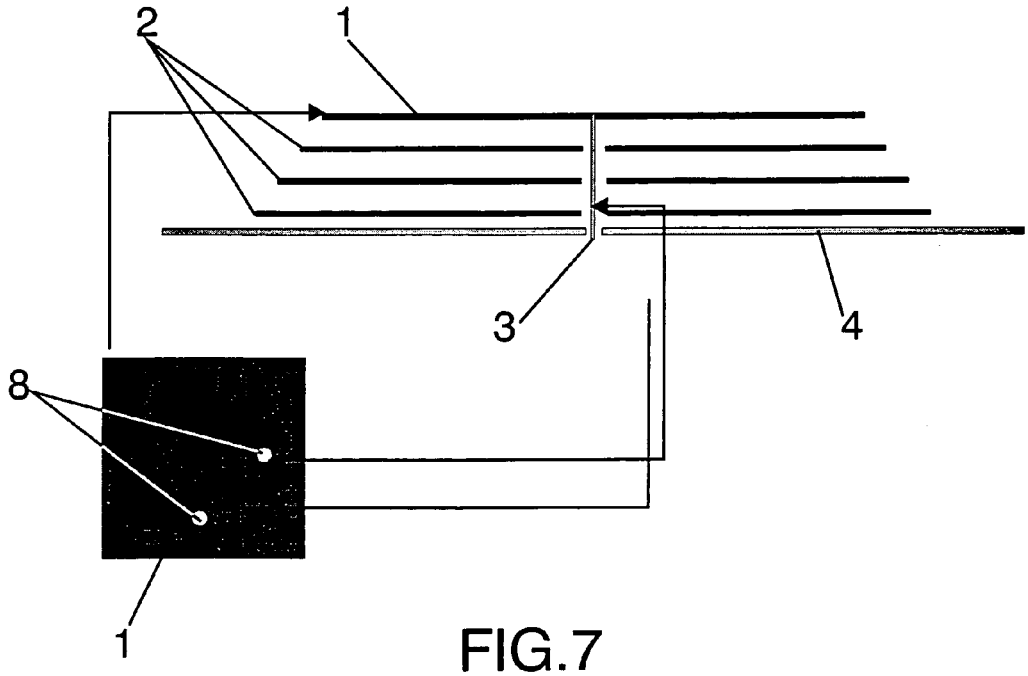
FIG. 7 Shows a top view of the feeding point on the active patch. Two probe feeds are used to achieve a dual-polarized or circular-polarized antenna.

The said active (1) patch feeding scheme can be taken to be any of the well-known schemes used in prior art patch antennas for instance: coaxial probe (3) as shown in FIG. 1, coaxial probe (3) and capacitor (5) as shown in FIGS. 2, 3, L-shaped coaxial probe (3') as shown in FIG. 4, or slot fed probe. In the case of the probe-feeding scheme, the pin, wire or post of the feeding Probe crosses all parasitic patches (2) through an aperture at each of said parasitic patches. When the antenna is fed by means of a microstrip line underneath the ground-plane (4), a slot on said ground-plane (4) and on each of the individual parasitic patches (2) provides a mean to feed the upper active patch (1). It would be apparent to those skilled in the art that clear that, whatever the feeding mechanism is, two feeding ports (8) shown in FIG. 7, can be used in order to obtain a dual polarized, slant polarized, elliptical polarized or circular polarized antenna.

Figure 8:
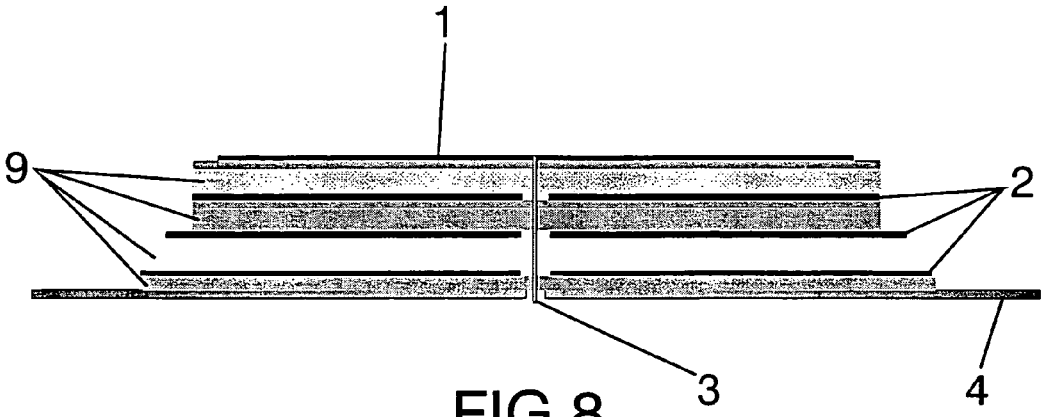
FIG. 8 As FIG. 1 but in this case several layer of different dielectric are used between the radiating elements.

The medium between the active and parasitic elements can be air, foam or any standard radio frequency and microwave substrate. Moreover, several different dielectric layers (9) can be used, for instance: the patches can be etched on a rigid substrate such as Rogers 4003® or fibber glass and soft foam can be introduced to separate the elements (FIG. 8).

Figure 5:
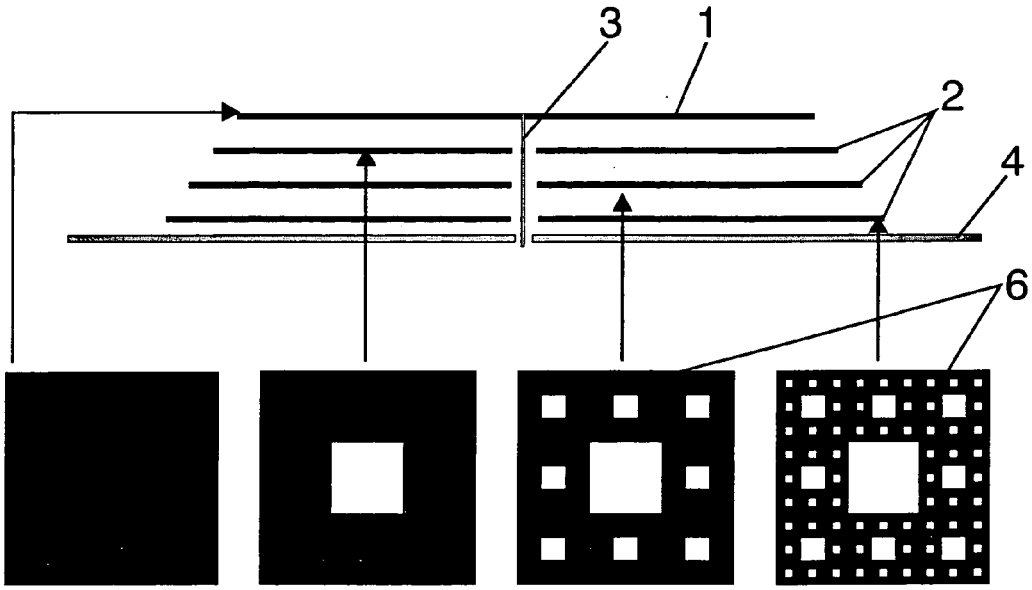
FIG. 5 Shows a square-shaped active patch and several parasitic patches based on a particular example of multilevel geometry.
Figure 6:
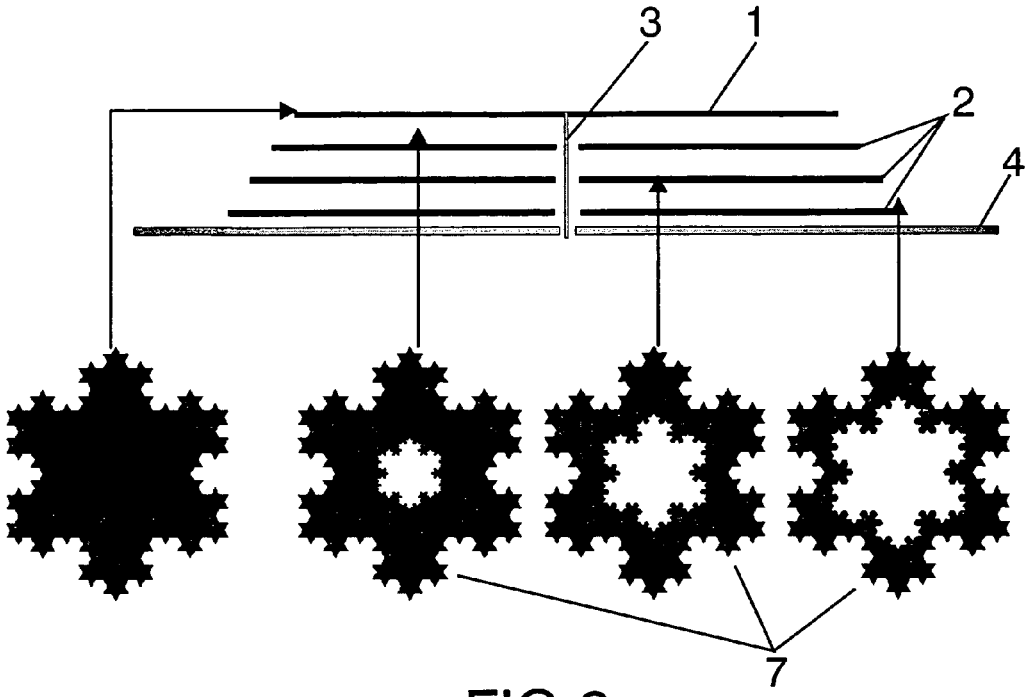
FIG. 6 As FIG. 5 but in this case the patches are based on a particular example of space-filling geometry.

Dimensions of either active (1) or parasitic patches (2) are adjusted in order to obtain the desired multifrequency operation. Typically, patches have a size between a quarter wavelength and a full-wavelength on the desired operating frequency band. When a short-circuit is included in for instance one of the patches, then the size of the said patch can be reduced below a quarter wavelength. In the case of space-filling perimeter patches, the size of the patch can be made larger than a full-wavelength if the operation through a high-directivity high-order mode is desired. Patch shapes and dimensions can be different in order to obtain such multifrequency operation and to obtain a compact antenna. For instance, dimensions of patches can be further reduced using space-filling (7) or a multilevel geometry (6). This reduction process can be applied to the whole structure or only to some elements (FIGS. 5 and 6). Also, in some embodiments, the multiband behavior of said multilevel or space-filling geometries can be used in combination with the multiband effect of the multilayer structure of the present invention to enhance the performance of the antenna.

Figure 9:
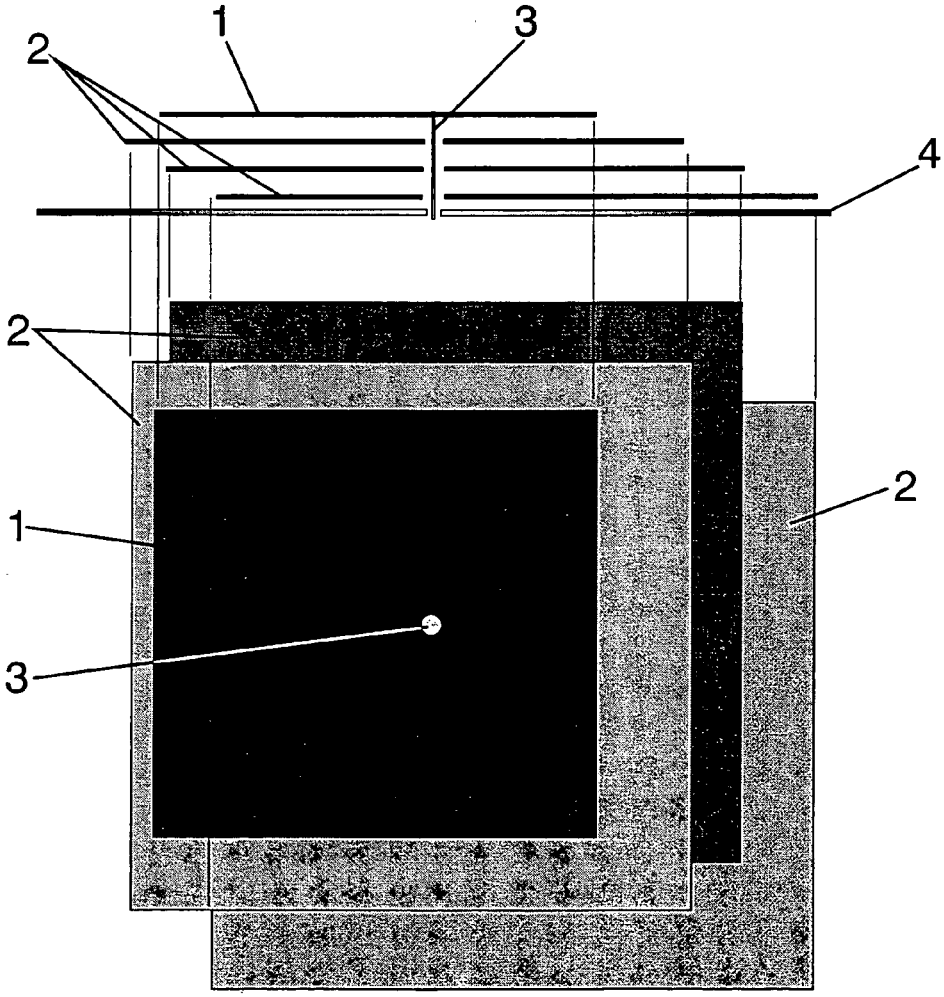
FIG. 9 Shows an arrangement where the active and parasitic patches are non-aligned, that is, the centre of each element does not lie on the same axis.

The active and parasitic patch centres can be non-aligned in order to achieve the desired multifrequency operation. This non-alignment can be in the horizontal, vertical or both axis (FIG. 9) and provides a useful way of tuning the band of the antenna while adjusting the impedance and shaping the resulting antenna pattern.

It is clear to those skilled in the art, that the multiband behavior featured by the antenna device disclosed in the present invention will be of most interest in those environments such as for instance, base-station antennas in wireless cellular systems, automotive industry, terminal and handset industry, wherein the simultaneous operation of several telecommunication systems through a single antenna is an advantage. An antenna device like the one described in the present invention can be used, for instance, to operate simultaneously at a combination of some of the frequency bands associated with AMPS, GSM900, GSM1800, PCS1899, CDMA, UMTS, Bluetooth, TACS, ETACS, DECT, Radio FM/AM, DAB, GPS or in general, any other radiofrequency wireless system.

The invention claimed is:

1. A multi-frequency microstrip patch antenna device comprising:

a ground-plane or ground-counterpoise;

a first conducting layer, said conducting layer acting as an active patch for the whole antenna device, said active patch being fed at least at a point of said first conducting layer;

at least two additional conducting layers acting as parasitic patches, said parasitic patches being placed underneath said active patch, at different levels between said active patch and said ground-plane or ground-counterpoise; and wherein at least one of said at least two additional conducting layers acting as parasitic patches is not short-circuited to said ground-plane or ground-counterpoise.

2. A microstrip patch antenna device according to claim 1, wherein at least one of the parasitic patches includes a multilevel structure.

3. The microstrip patch antenna device according to claim 1 or 2, wherein at least one of the parasitic patches includes a space-filling structure.

4. The microstrip patch antenna device according to claim 1, wherein at least the active patch includes a multilevel structure, a space-filling structure or a combination of a multilevel structure and a space-filling structure.

5. The microstrip patch antenna device according to claims 1 or 4, wherein a geometry of the active patch is selected from the group consisting of: square, circular, rectangular, triangular, hexagonal, octagonal and fractal.

6. The microstrip patch antenna device according to claim 1, wherein a geometry of the parasitic patches is selected from the group consisting of: square, circular, rectangular, triangular, hexagonal, octagonal and fractal.

7. The microstrip patch antenna device according to claim 1, wherein the active patch and the parasitic patches have different shapes and dimensions.

8. The microstrip patch antenna device according to claim 1, wherein the antenna features a multiband behavior at as many bands as patch layers in the antenna arrangement.

9. The microstrip patch antenna device according to claim 1, wherein the antenna features a broadband behavior.

10. The microstrip patch antenna device according to claim 1, wherein said antenna is used to operate simultaneously for several communication systems.

11. The microstrip patch antenna device according to claim 1, wherein the antenna is fed at the active patch at two feeding points to provide dual polarization, slant polarization, circular polarization, elliptical polarization or a combination thereof.

12. The microstrip patch antenna device according to claim 1, wherein at least one of the patches is larger than an operating wavelength and at least a portion of a perimeter of said patch is a space-filling curve and the antenna is operated at a localized resonating mode of order larger than one for said particular patch.

13. The microstrip patch antenna device according to claim 1, wherein a centre of at least one patch is non-aligned with a vertical axis orthogonally crossing the active patch at its centroid.

14. The microstrip patch antenna device according to claim 1, wherein at least one patch is not horizontally aligned with respect to the other patches.

15. The microstrip patch antenna device according to claim 1, wherein the antenna is fed by means of at least a conducting pin, a conducting wire or a conducting post, said conducting pin, wire or post crossing all the layers through an aperture at each of the parasitic patches, and said conducting pin, wire or post being electromagnetically coupled to the active patch either by means of ohmic contact or capacitive coupling.

16. The microstrip patch antenna device according to claim 1, wherein the antenna is fed by means of a microstrip line, said microstrip line being placed underneath the ground-plane and coupled to the upper patch by means of a slot on each individual parasitic patch and on the ground-plane.

17. The microstrip patch antenna device according to claim 1, wherein the active and the parasitic patches are printed over a dielectric substrate.

18. The microstrip patch antenna device according to claim 17, wherein said dielectric substrate is a portion of a window glass of a motor vehicle.

19. The microstrip patch antenna device according to claim 1, wherein the antenna device operates simultaneously at any combination of frequency bands selected from the group consisting of: AMP, GSM900, GSM1800, PCS1899, CDMA, UMTS, Bluetooth, TACS, ETACS, DECT, Radio FM/AM, and GPS.

20. The microstrip patch antenna device according to claim 1, wherein the active patch is short-circuited to said ground-plane or ground-counterpoise.

21. The microstrip patch antenna device according to claim 1, wherein none of the at least two conducting layers acting as parasitic patches is short-circuited to said ground-plane or ground-counterpoise.

* * * * *